United States Patent [19]

Kohyama et al.

[11] Patent Number: 4,586,460

[45] Date of Patent: May 6, 1986

[54] DEVELOPING APPARATUS

[75] Inventors: Mitsuaki Kohyama, Tokyo; Takashi Shimazaki, Kawasaki, both of Japan

[73] Assignee: Kabushiki Kaisha Toshiba, Kawasaki, Japan

[21] Appl. No.: 646,162

[22] Filed: Aug. 31, 1984

[30] Foreign Application Priority Data

Aug. 31, 1983 [JP] Japan ..... 58-161241

[51] Int. Cl.[4] ..... G03G 15/08

[52] U.S. Cl. ..... 118/653

[58] Field of Search ..... 118/653, 657, 658

[56] References Cited

U.S. PATENT DOCUMENTS 3,232,190 2/1966 Willmott et al. ..... 95/1.7
3,866,574 2/1975 Hardennrook et al. ..... 118/637
4,226,524 10/1980 Hashimoto ..... 118/657 X
4,232,628 11/1980 Shelffo ..... 118/653
4,380,966 4/1983 Isaka et al. ..... 118/657 X
4,406,535 9/1983 Sakamoto et al. ..... 118/658 X

*Primary Examiner*—Bernard D. Pianalto
*Attorney, Agent, or Firm*—Cushman, Darby & Cushman

[57] ABSTRACT

A developing apparatus is provided with a developing roll for carrying a toner thereon and an elastic blade pressed against the surface of the developing roll to apply the toner thereto. The toner is thus applied to the surface of the developing roll by the elastic blade to form a thin layer of the toner on the surface of the developing roll. The thin layer is opposed to a photosensitive drum at a predetermined space to deposit the toner on an electrostatic latent image in the photosensitive drum. The elastic blade is pivotally supported by a pivotal shaft about a central portion of the elastic blade.

6 Claims, 6 Drawing Figures

DEVELOPING APPARATUS

BACKGROUND OF THE INVENTION

The present invention relates to a developing apparatus for depositing a developing agent on an image carrier with a latent image thereon, thereby developing the latent image.

Development is achieved, for example, when a developing agent (colored powder called toner) which is charged with a polarity opposite to that of the electric charges forming an electrostatic latent image is electrostatically attracted to the electrostatic latent image. Developing agents include one-component developing agents which consist of a powdery toner only or a toner coated with $SiO_2$ or another additive, and two-component developing agents which are composed of a powdery toner and a carrier as it is called, such as magnetic powder or fine resin powder, glass, etc. In the two-component developing agents, the toner is securely charged by friction with the carrier. To maintain a constant developing density, on the other hand, the mixture ratio between toner and carrier, i.e., toner density, must be kept constant. Requiring no such control of toner density, the one-component developing agents surpasses the two-component developing agents in easy handling.

The one-component developing agents are classified into two types, magnetic and nonmagnetic. In general, a nonmagnetic developing agent is prepared by mixing resin powder with a color agent such as carbon, while a magnetic developing agent is a mixture of resin powder and magnetic powder.

A prior art method using a one-component developing agent is an application of the so-called no-contact developing process stated in Japanese Patent Publication No. 9475/66. In this developing process, an image carrier is opposed to a layer of a developing agent on a developing agent carrier at a fixed space, and a suitable bias is applied to the developing agent layer to fly the developing agent to image portions of an electrostatic latent image on the image carrier. The no-contact developing process is superior to any other developing methods in the following points. Since a developing agent with electric insulating property or high resistance can be used in the process, there is no possibility of defective transfer. Moreover, the developing agent will not cause fog, since it will not be flown to the no-image portions of the electrostatic latent image. In developing an electrostatic latent image by the no-contact developing process, the distance between the image carrier and the developing agent carrier must be minimized for a visible image of higher quality. Naturally, therefore, the developing agent layer on the developing agent carrier needs to be very thin and uniform.

In order to form such a thin layer of developing agent, a film forming method is disclosed in Japanese Patent Disclosure No. 43037/79 in which a thin layer of a magnetic developing agent is formed on a developing agent carrier containing magnetic field generating means therein. According to this method, a uniformly thin layer of magnetic developing agent can be formed with high reliability. Thus, a satisfactory visible image may be obtained by the use of the no-contact developing process.

The no-contact developing process, however, requires as indispensable requisites a magnetic field generating means, i.e., a magnet, and a magnetic developing agent composed of toner and magnetic powder dispersed therein. Thus, this developing process has the following drawbacks:

(1) the use of the magnet in the developing agent carrier renders the apparatus complicated and expensive, constituting a hindrance to the reduction of the size and weight of the apparatus, (2) the magnetic developing agent is more expensive than the nonmagnetic one, and (3) containing magnetic powder, the magnetic developing agent is poor in coloring capability and is unsuited for color print.

Thus, the no-contact developing process using the magnetic developing agent has the substantial drawbacks attributed to the use of the magnetic developing agent, as well as many advantages.

Meanwhile, a no-contact developing process using a nonmagnetic developing agent may be considered an ideal developing method which can settle all the problems related to the prior art method. However, this alternative process has one major problem in that the use of the nonmagnetic developing agent makes it difficult to form a uniformly thin layer of the developing agent stably on the developing agent carrier. Therefore, this method has not yet been put to practical use.

In a conventional developing apparatus using a one-component developing agent, an elastic blade consisting of urethane rubber or stainless steel is pressed against the surface of a developing agent carrier so as to apply the developing agent thereon. When a nonmagnetic developing agent, for example, is used, the nonmagnetic developing agent is charged by friction between the elastic blade and the developing agent carrier and the developing agent is applied on the surface of the developing agent carrier.

However, in such a conventional apparatus, when the elastic blade is pressed against the surface of the developing agent carrier, the proximal end of the blade is entirely held. For this reason, it is difficult to uniformly press the elastic blade against the surface of the developing agent carrier. It is therefore difficult to form a uniformly thin layer of developing agent on the surface of the developing agent carrier.

SUMMARY OF THE INVENTION

The present invention is contrived in consideration of these circumstances and is intended to provide a developing apparatus capable of forming a uniformly thin layer of a developing agent on a developing agent carrier to produce a visible image of good quality, even though the developing agent is pressed onto the surface of the developing agent carrier by an elastic member.

According to one aspect of the present invention, there is provided a developing apparatus comprising: a developing agent carrier for carrying a developing agent thereon; an elastic member pressed against the surface of the developing agent carrier in one direction to apply the developing agent thereto, so that the developing agent is applied to the surface of the developing agent carrier by the elastic member to form a layer of the developing agent on the surface of the developing agent carrier, and that the layer is opposed to an image bearing member at a predetermined space to deposit the developing agent on a latent image on the image bearing member; and supporting means for pivotally supporting the elastic member about a central portion thereof which is along said one direction.

DETAILED DESCRIPTION OF THE PREFERRED EMBODIMENTS

One embodiment of a developing apparatus according to the present invention applied to an image forming apparatus will now be described in detail with reference to the accompanying drawings of FIGS. 1 to 6.

Figure 1:
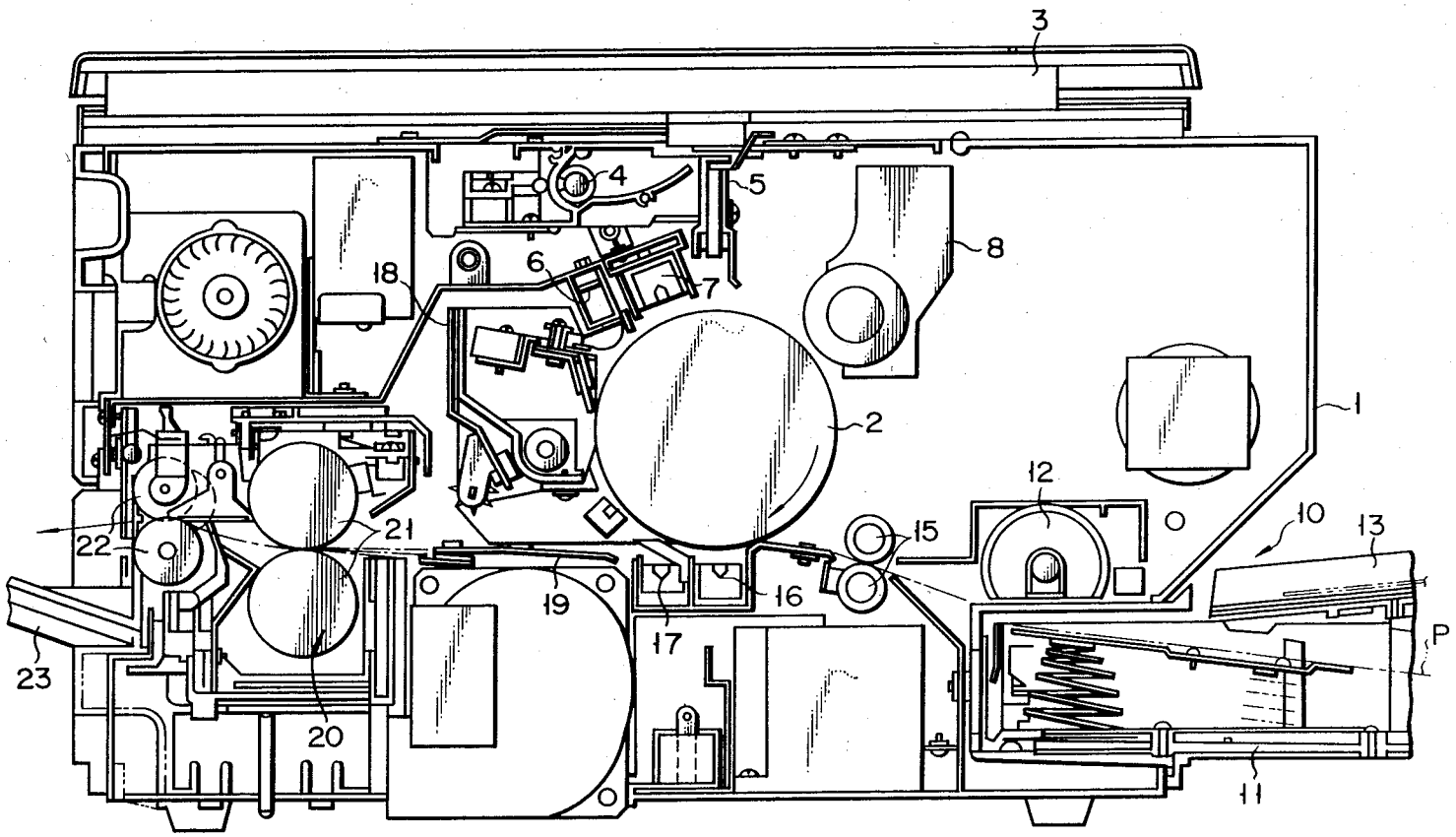
FIG. 1 is a sectional view schematically showing a copying machine using a developing apparatus according to the present invention.

First, the image forming apparatus, e.g., a copying machine, using the developing apparatus of the invention will be described. FIG. 1 is a sectional view schematically showing the copying machine. In FIG. 1, numeral 1 designates a housing of the copying machine. Rotatably disposed in the central portion of the housing 1 is an image carrier, e.g., a photoconductive drum 2 made of selenium, on the surface of which is formed an electrostatic latent image. The photoconductive drum 2 is surrounded by a lamp 4 and a convergent light transmitting member 5 for optically scanning an original paper put on a horizontally reciprocating original table 3 and for forming an electrostatic latent image corresponding to an image of the original paper on the surface of the photoconductive drum 2, a discharge lamp 6 for de-electrifying the surface of the photoconductive drum 2 before the formation of the original image, a charger 7 for uniformly charging the surface of the photoconductive drum 2 after the de-electrification, and a developing apparatus 8 according to the invention for selectively flying a developing agent to the electrostatic latent image on the surface of the photoconductive drum 2 to develop the electrostatic latent image. Thus, the developing apparatus 8 forms a visible image on the surface of the photoconductive drum 2.

A paper feeding section 10 is provided at one side portion (right-hand side portion of FIG. 1) of the housing 1. The paper feeding section 10 includes a paper cassette 11 removably attached to the one side portion of the housing 1, a paper supply roller 12 in rolling contact with the uppermost one of sheets P contained in the paper cassette 11 and capable of delivering the sheets P one by one into the housing 1, and a sheet-bypass guide 13 for manual paper supply. Each sheet P delivered from the paper feeding section 10 is regulated for feed timing by a pair of aligning rollers 15, and fed so as to be in rolling contact with the photoconductive drum 2 in a transfer section.

The photoconductive drum 2 is also surrounded by a pre-transfer charger 9, a transfer charger 16 for transferring the developing agent to the sheet to form a visible image thereon, and a separation charger 17 for separating the sheet from the photoconductive drum 2 after transfer. The transfer section is defined between the photoconductive drum 2 and the transfer charger 16. After the developing agent image (visible image) is transferred to the sheet, the sheet is guided to a fixing unit 20 by a conveyor belt 19. The developing agent is fixed by the pressure and heat of a pair of heat rollers 21 which constitute the fixing unit 20. After the fixation, the sheet is discharged onto a tray 23 by a pair of exit rollers 22. After the transfer operation, the developing agent remaining on the surface of the photoconductive drum 2 is removed by a cleaning unit 18.

Figure 2:
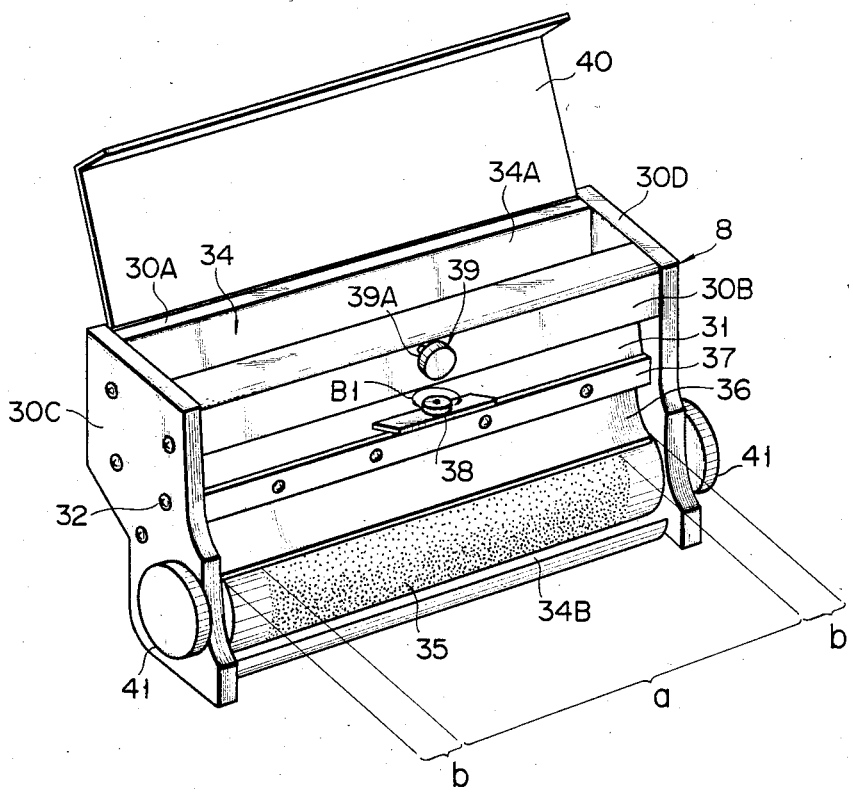
FIG. 2 is a perspective view schematically showing a developing apparatus according to one embodiment of the invention.
Figure 3:
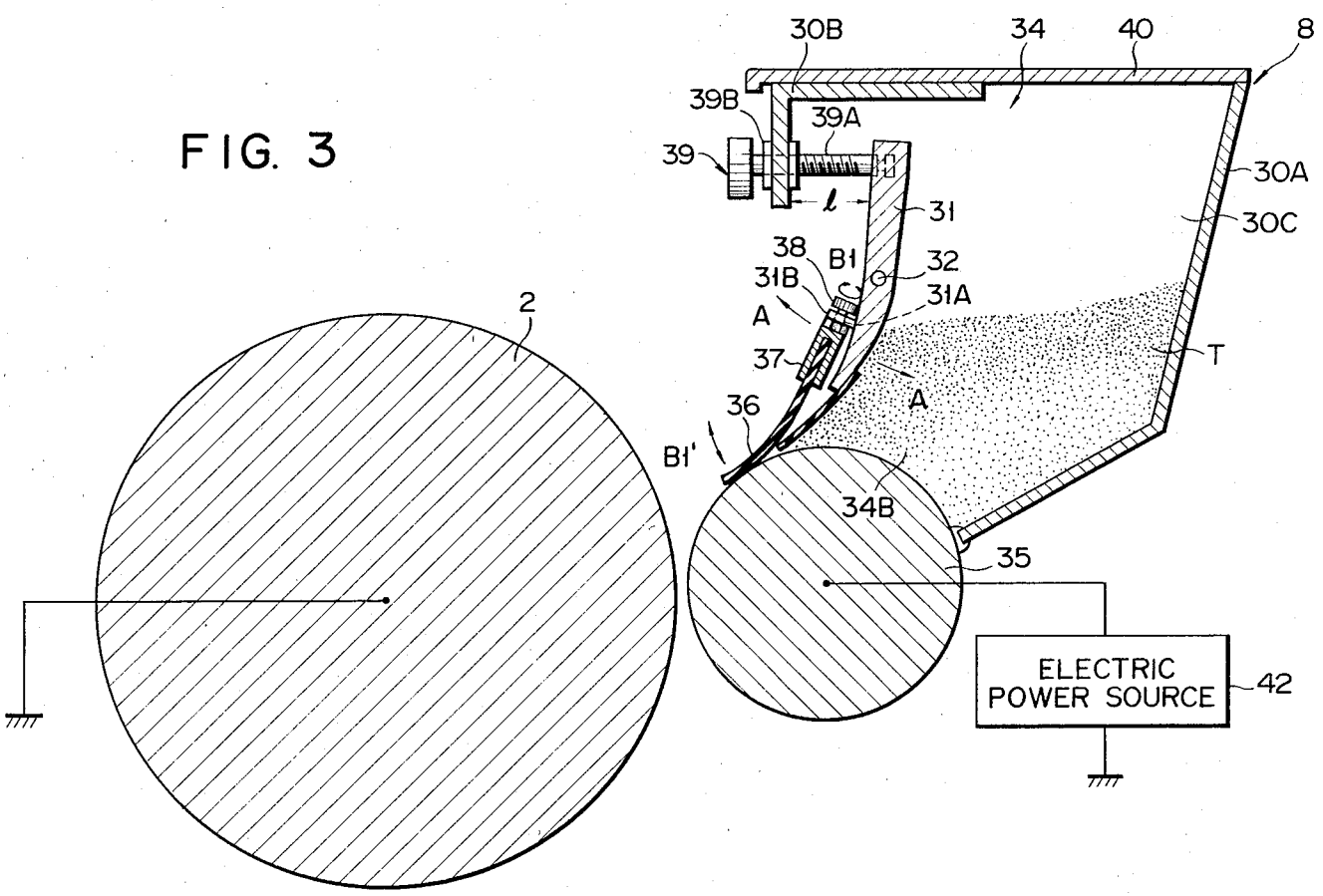
FIG. 3 is a sectional view schematically showing the developing apparatus of FIG. 2.

The developing apparatus 8 according to the first embodiment of the invention will be described in detail. FIGS. 2 and 3 are a perspective view and a sectional view, respectively, schematically showing the developing apparatus 8.

The developing apparatus 8 shown in FIG. 3 uses a nonmagnetic developing agent. However, a one-component magnetic developing agent can also be used in this apparatus. The developing apparatus 8 has a housing 34 for housing the developing agent. Side frames 30C and 30D are mounted at the ends of a back frame 30A and a front stay 30B, respectively, which are spaced apart from each other. A holder 31 is supported through a support member, for example, a pin 32, below the front stay 30B to the side frames 30C and 30D to be pivotal in a direction indicated by arrow A. A cover 40 which can be opened to allow a supply of developing agent covers a top opening 34A of the housing 34. A developing agent carrier for carrying and conveying a developing agent thereon, for example, an aluminum or stainless steel developing roller 35 is pivotally supported by the side frames 30C and 30D in the vicinity of a bottom opening 34B.

An elastic member such as an elastic blade 36 is pressed against the developing roller 35 to coat a developing agent T on the surface of the developing roller 35. The elastic blade 36 is arranged to extend along the longitudinal direction of the holder 31 through a blade holder 37. The elastic blade 36 can consist of silicon butadiene rubber (40 to 90 hardness), urethane rubber, stainless still, a phosphor bronze layer (about 0.01 to 0.5 mm thick), or a urethane sheet. One end of a mounting member 38 is fixed to an intermediate portion of the blade holder 37. The other end of the mounting member 38 is rotatably mounted in a mounting hole 31A of a projection 31B formed on the outer surface of the holder 31. The elastic blade 36 is free to pivot about its intermediate portion in a direction indicated by arrow B1 (to move toward or away from the pressing surface of the developing roller 35). In this manner, when the free end of the elastic blade 36 is uniformly pressed against the ends of the roller 35 upon rotation thereof by pivoting in the direction of arrow B1, a uniformly thin layer of developing agent is formed.

An adjusting member 39 is arranged at the upper end of the front stay 30B. The adjusting member 39 pivots the holder 31 so as to adjust the pressing force of the elastic blade 36 against the developing roller 35. The adjusting member 39 has an adjusting screw 39A. One end of the adjusting screw 39A is pivotally supported by the holder 31. An intermediate portion of the adjusting screw 39A is screwed in a screw member 39B mounted on the front stay 30B. When the adjusting screw 39A is rotated so as to adjust the distance l between the holder 31 and the front stay 30B, the holder 31 is pivoted about the pin 32. Thus, the pressing force of the elastic blade 36 is adjusted.

Part of the surface of the elastic blade 36 opposed to the developing roller 35 is in surface contact with the developing roller 35. Therefore, the contact area between the elastic blade 36 and the developing roller 35 is wider than in the case of the prior art construction in which the free end portion of the elastic blade is pressed against the developing roller. Thus, the fine adjustment of the contact pressure on the developing roller 35 is easy, and the contact pressure can be made uniform. Also, the developing agent can enjoy friction under the contact pressure for a longer time, thus acquiring uniform and sufficient electric charges.

The developing apparatus 8 is located in a position such that the developing agent layer on the developing roller 35 is not in contact with the photoconductive drum 2. A gap G between the developing roller 35 and the photoconductive drum 2 depends on the particle size of the developing agent and the thickness of the developing agent layer. To ensure the flight of the developing agent for a visible image of good quality, it is necessary to minimize the gap G. The gap G can be narrowed only if the developing agent layer on the developing roller 35 is a thin layer. The range of the particle size of the developing agent used depends on the resolution of the desired image. Thus, the practical gap G between the developing roller 35 and the photoconductive drum 2 ranges from approximately 50 to 400 microns. Here the thin layer may be a monolayer or a multilayer, including up to six or seven layers, of the developing agent.

To maintain the accuracy of the gap G, a pair of gap control rollers 41 are mounted on the shaft of the developing roller 35 so as to be rotatable in a body. The gap control rollers 41 come into contact with both side portions of the peripheral surface of the photoconductive drum 2 or engaging rollers (not shown) mounted on the shaft of the photoconductive drum 2, thereby keeping the intercentral distance between the photoconductive drum 2 and the developing roller 35. A power source 42 is provided for applying a voltage to the developing roller 35 to form an electric field between the photoconductive drum 2 and the developing roller 35 and generally includes D.C. power source or deviated A.C. power source. The power source 42, which is not requisite for the developing apparatus 8 of the invention, serves to facilitate the flight of the developing agent on the developing roller 35 to the surface of the photoconductive drum 2 by forming the electric field between the two members 2 and 35 by a D.C. or A.C. power cource. The developing agent frictionally charged on the developing roller 35 is transferred to the surface of the photoconductive drum 2 by only an electrostatic attraction attributed to latent image charges on the surface of the photoconductive drum 2.

Figure 4:
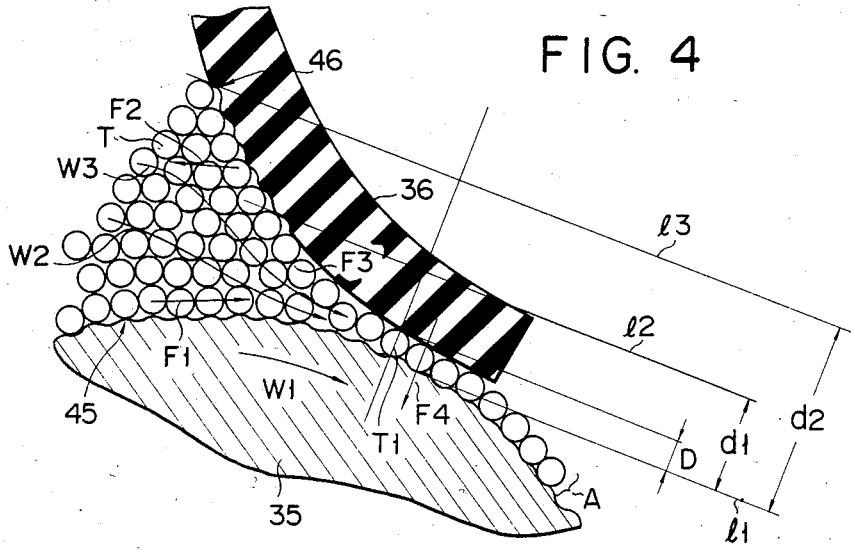
FIG. 4 is a sectional view showing how an elastic plate is pressed against a developing roller in the developing apparatus of FIG. 2.

The developing roller 35 and the elastic blade 36 will now be described in detail. As shown in FIG. 4, a first rugged surface portion 46 is formed on part of the surface of the elastic blade 36 which faces the developing roller 35, while a second rugged surface portion 45 is formed on the peripheral surface of the developing roller 35.

Figure 5:
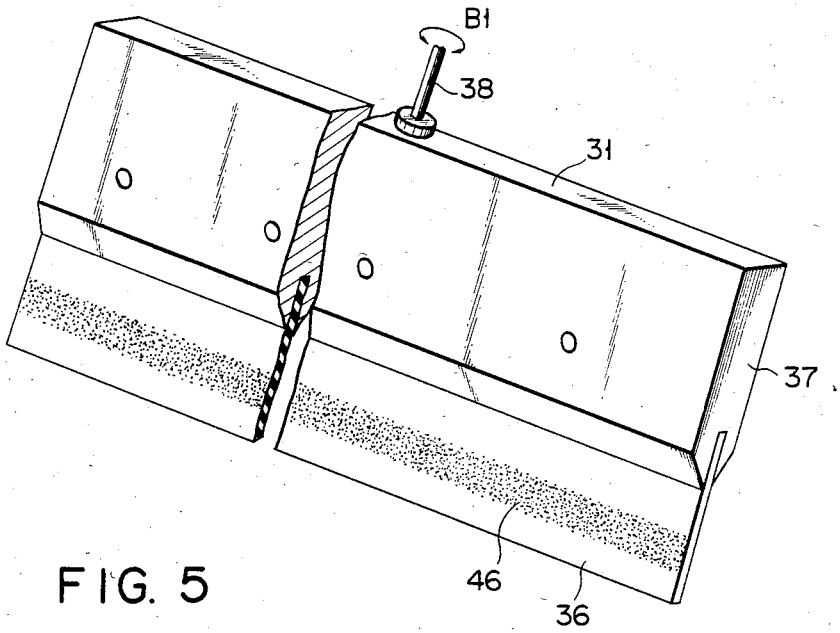
FIG. 5 is a perspective view schematically showing the elastic blade.

As shown in FIG. 4, the first rugged surface portion 46 is located in a region not in contact with a monolayer A of the developing agent, which is sandwiched between the developing roller 35 and the elastic blade 36. More specifically, the first rugged surface portion 46 is formed on the lower side surface of the elastic blade 36 in a region between parallel lines l2 and l3. Here the line l2 is parallel to and at a distance d1 (twice or thrice the particle size D of the developing agent) from a tangent line l1 which touches the circumference of the developing roller 35 at the contact point between the developing roller 35 and a specific developing agent particle T1 under contact pressure, and the line l3 is at a distance d2 (10 to 50 times the particle size D) from the tangent line l1. As shown in FIG. 5, the first rugged surface portion 46 extends over the full length of the elastic blade 36 along the axial direction of the developing roller 35. The first rugged surface portion 46 is roughed by sand blasting or buffing so that its roughness ranges from 0.1 D to 2.0 D where D is the particle size of the developing agent.

Likewise, the second rugged surface portion 45 is roughed by sand blasting or buffing so that its roughness ranges from 0.07 D to 1.5 D. As shown in FIG. 2, the second rugged surface portion 45 is formed in a developing region or a peripheral surface region of a maximum developing width (a), which is substantially equal to the maximum image forming width of the photoconductive drum 2. A nondeveloping region of a nondeveloping width (b) is formed on each side of the developing region. The nondeveloping region is not roughed and has a smooth surface.

The operation and function of the developing apparatus 8 will now be described. The housing 34 of the developing apparatus 8 is filled with the developing agent T, and the developing roller 35 is rotated in the clockwise direction indicated by arrow W1 in FIG. 4. The developing agent T is fed in the direction of arrow W1 by the conveying force of the developing roller 35 and another agency. In this process, the developing agent T is frictionally charged between the developing roller 35 and the elastic blade 36. Since the second rugged surface portion 45 is formed on the surface of the developing roller 35, the conveying force F1 of the developing roller 35 to carry the developing agent T in contact with or near the surface of the developing roller 35 is increased. Thus, the developing agent T near the developing roller 35 is securely fed in the direction of arrow W1. The developing agent in contact with the first rugged surface portion 46 of the elastic blade 36 is subjected to a relatively large resisting force F2, and the flow of the developing agent T becomes slower as it approaches the first rugged surface portion 46. Since the lower-course side (corresponding to the range of the distance d1 of FIG. 4) of the surface of the elastic blade 36 with respect to the first rugged surface portion 46 is smooth, the developing agent T touching that surface portion is subjected to only a relatively small resisting force F3 and can flow smoothly.

Since the first rugged surface portion 46 is not formed on the prior art elastic blade, only a relatively small resisting force acts on the developing agent along the elastic blade. In the prior art apparatus, therefore, the developing agent tends to rush to the contact point between the elastic blade and the developing roller from a relatively wide range, as indicated by arrow W3. Thus, the flow of the developing agent becomes dull, possibly causing cohesion of the developing agent or production of voids.

In this first embodiment, however, the developing agent T directed toward the contact point to receive a thrusting force F4 of the elastic blade 36 flows actively and smoothly within a narrow range close to the developing roller 35, as indicated by arrow W2. The layer of the flowing developing agent is gradually reduced in thickness as it approaches the lower-course side of the elastic blade 36. As a result, a uniformly thin layer of the developing agent is applied to the developing roller 35 by the lower-course side portion of the elastic blade 36. Thus, the developing agent directed toward the contact point of the elastic blade 36 flows smoothly, and the thickness of the layer of the flowing developing agent is gradually reduced. Consequently, the developing agent T may securely be prevented from forming an uneven, thin layer or being irregularly charged as the elastic blade 36 is unduly forced up by an uneven or irregular flow of the developing agent T or by foreign matter mixed therein.

When a uniformly thin film of the developing agent T is formed on the surface of the developing roller 35, the frictionally charged developing agent T forming the thin layer is selectively flown to the electrostatic latent image on the surface of the photoconductive drum 2 by the agency of the electric field formed between the developing roller 35 and the photoconductive drum 2. Thus, the electrostatic latent image is developed into a visible image. Since the thin layer of the developing agent applied to the developing roller 35 is uniform, the selectively flown developing agent is also uniform at every part of the electrostatic latent image, ensuring production of a visible image of high quality. For the same reason, the gap G between the developing roller 35 and the photoconductive drum 2 need only be a little wider than the thickness of the thin layer. Thus, the gap G can be minimized to secure the flight of the developing agent for the development of a satisfactory visible image. The uniformly thin layer of the developing agent permits no-contact development with use of a one-component, nonmagnetic developing agent. In the no-contact development, a layer of a developing agent applied to a developing agent carrier is opposed to an image carrier so that the developing agent is flown only to an electrostatic latent image on the image carrier. Thus, the developing apparatus 8 of the invention can be applied with high reliability to superpositive development, which is essential for color printing, and the image carrier can securely be prevented from breakage due to contact with the developing agent carrier or from deterioration with the passage of time.

Figure 6:
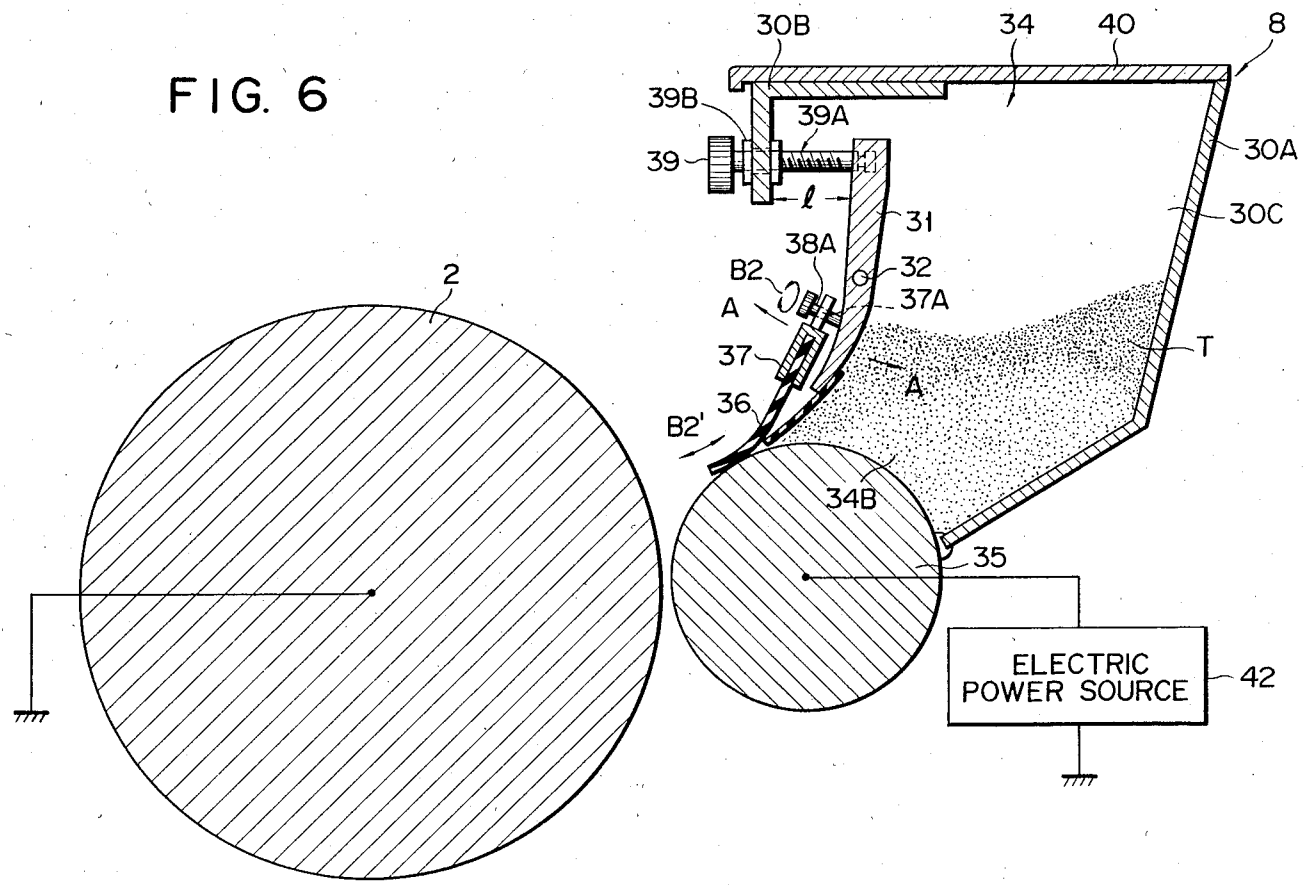
FIG. 6 is a sectional view schematically showing a developing apparatus according to the other embodiment of the present invention.

FIG. 6 is a schematic sectional view showing another embodiment of a developing apparatus of the present invention. The same reference numerals as in FIG. 3 denote the same parts in FIG. 6, and a detailed description thereof will not be made.

The embodiment shown in FIG. 6 is different from that shown in FIG. 3 in the following respects. A through hole 37A is formed at an intermediate portion of a blade holder 37 mounting an elastic blade 36 thereon. The blade holder 37 is pivotally mounted to a holder 31 through a pin 38A received in the through hole 37A. In this manner, the blade holder 36 is moved on the pressing surface of the developing roller 35 upon rotation thereof at a uniform pressure at each end of the roller 35 since it is pivotal in the direction of arrow B2.

Since the intermediate portion of the elastic blade 36 is pivotally supported in the direction B2 in this manner, the following effect is obtained. If a foreign material is introduced in the developing agent and is located between the developing roller 35 and the elastic blade 36, the resisting force increases and the flowability of the developing agent is impaired. When an abnormality occurs in the frictional force of the developing agent acting between the developing roller 35 and the elastic blade 36, the flowability of the developing agent is also impaired. In such a case, the elastic blade 36 is pivoted about the pin 38A in the direction B2 so as to shift the position of the contact portion between the developing roller 35 and the elastic blade 36 in a direction of arrow B2' and to eliminate the increase in the resisting force. As a consequence, the flowability of the developing agent is controlled and a uniformly thin layer can be formed.

The elastic blade 36 can be pivotal in both directions B1 (FIG. 3) and B2 (FIG. 6), and can be movable in directions B1' and B2'.

The present invention is not limited to the particular embodiment described above. Various parts of the embodiments described above can be replaced with other parts of the same functions. For example, a developing agent carrier need not be an aluminum or stainless steel drum but can be a metal plate or belt. The surface of such a carrier can be treated by Almite treatment or by hard chromium plating. Such a surface treament can prevent wear of the second rugged surface portion of the surface of the developing agent carrier. Then, the stable development over time and the long life of the developing agent carrier can be ensured. An electrostatic latent image to be developed by the developing apparatus of the present invention is not limited to that formed by the apparatus shown in FIG. 1, but can be any pattern of charged particles which is formed by a CRT, a laser beam, a needle electrode or an LED. Furthermore, the holder can be selectively pivoted by a drive member so as to intermittently press the elastic blade against the developing agent carrier. In other words, the drive member can be actuated in the operative period of the developing apparatus so as to press the elastic blade against the developing agent carrier only in such a period. The pressing of the elastic blade against the developing agent carrier can be released in the nonoperative period of the developing apparatus. In this case, the drive member can be a solenoid, a link mechanism or a cam mechanism.

As can be seen from the above description, in the developing apparatus of the present invention, since an intermediate portion of the elastic blade is pivotally supported, the elastic blade can be pressed against the developing agent carrier and a uniformly thin layer of developing agent can be formed on the surface of the developing agent carrier. The apparatus of the present invention is moreover simple in configuration and is simple to use.

What is claimed is:

1. A developing apparatus which develops a latent image on an image-bearer by means of a developing agent, said apparatus comprising:

a developing agent carrier having a cylindrical surface on which the developing agent is carried, said developing agent carrier having its ends mounted for rotational movement about a central axis thereof so that a portion of said cylindrical surface establishes a gap with said image-bearer;

an elastic member having its elongated length disposed in a longitudinal direction substantially parallel to said central axis, said elastic member having a free end in resilient contact with the cylindrical surface of the developing agent carrier to exert a predetermined force thereagainst for applying the developing agent to the cylindrical surface so as to form a layer of the developing agent on the cylindrical surface of the developing agent carrier such that the formed layer is opposed to the image-bearer at said space to permit the developing agent to be deposited on a latent image on the image-bearer; and supporting means defining a pivot axis extending through a longitudinal central portion of the elastic member, said pivot axis being perpendicular to said longitudinal direction, said supporting means pivotally supporting the elastic member for pivotal movements about said pivot axis, wherein said supporting means permits said predetermined force to be uniformly exerted against said cylindrical surface between the ends of said developing agent carrier due to pivotal movement of said elastic member about said pivot axis thereby forming a uniform layer on said cylindrical surface.

2. The developing apparatus according to claim 1, which further comprises:

housing means for housing the developing agent therein and for supplying the developing agent to the developing agent carrier, the supporting means being mounted on said housing means.

3. The developing apparatus according to claim 2, wherein the supporting means includes:

a holding frame mounted at a proximal end, opposite said free end, of the elastic member and extended parallel to said longitudinal direction thereof;

a support frame mounted on the housing; and support shaft means establishing said pivot axis for pivotally mounting the holding frame, and thus said elastic member, to the support frame for pivotal movements about said pivot axis.

4. The developing apparatus according to claim 3, wherein said support shaft outwardly extends within a surface of the elastic member in a direction perpendicular to said longitudinal direction thereof.

5. The developing apparatus according to claim 3, wherein said support shaft means is disposed perpendicular to a surface of the elastic member.

6. The developing apparatus according to claim 3, wherein the support frame includes a pivot pin for pivotally mounting the support frame to the housing for pivotal movements relative to the housing about an adjustment axis parallel to said central axis.

* * * * *